US010714008B1

(12) United States Patent
Lu

(10) Patent No.: US 10,714,008 B1
(45) Date of Patent: Jul. 14, 2020

(54) TFT PIXEL THRESHOLD VOLTAGE COMPENSATION CIRCUIT

(71) Applicant: Sharp Kabushiki Kaisha, Osaka (JP)

(72) Inventor: Tong Lu, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 16/429,408

(22) Filed: Jun. 3, 2019

(51) Int. Cl.

| | |
|---|---|
| ***G09G 3/20*** | (2006.01) |
| ***G09G 3/3233*** | (2016.01) |
| ***G09G 3/3266*** | (2016.01) |
| ***G09G 3/3291*** | (2016.01) |

(52) U.S. Cl.
CPC ..... *G09G 3/3233* (2013.01); *G09G 3/3266* (2013.01); *G09G 3/3291* (2013.01); *G09G 2300/043* (2013.01); *G09G 2300/0426* (2013.01); *G09G 2300/0809* (2013.01)

(58) Field of Classification Search
CPC .. G09G 3/3233; G09G 3/3266; G09G 3/3291; G09G 2300/0426; G09G 2300/043; G09G 2300/0809; H05B 33/08
See application file for complete search history.

(56) References Cited

U.S. PATENT DOCUMENTS

| | | | | |
|---|---|---|---|---|
| 7,414,599 | B2 | 8/2008 | Chung et al. | |
| 7,812,796 | B2 * | 10/2010 | Jung | G09G 3/3233 345/76 |
| 8,242,983 | B2 | 8/2012 | Yoo et al. | |
| 9,196,196 | B2 | 11/2015 | Chung et al. | |
| 9,666,125 | B2 | 5/2017 | Chung | |
| 9,773,451 | B2 * | 9/2017 | Wu | G09G 3/3258 |
| 10,475,391 | B2 * | 11/2019 | Lu | G09G 3/3266 |
| 10,497,310 | B2 * | 12/2019 | Lu | G09G 3/3233 |
| 2009/0135107 | A1 * | 5/2009 | Kim | G09G 3/3241 345/76 |
| 2010/0013868 | A1 * | 1/2010 | Chung | G09G 3/3233 345/690 |
| 2012/0306843 | A1 * | 12/2012 | Wang | G09G 3/3258 345/212 |
| 2019/0156749 | A1 * | 5/2019 | Wang | G09G 3/3258 |

* cited by examiner

*Primary Examiner* — Joe H Cheng
(74) *Attorney, Agent, or Firm* — Renner, Otto, Boisselle & Sklar, LLP

(57) ABSTRACT

A pixel circuit for a display device employs a two-capacitor configuration, in which during the emission phase, the first and second plates of the capacitors respectively are electrically connected to each other to provide more stability to the gate voltage of the drive transistor. The pixel circuit also is operable in a combined threshold compensation and data programming phase to compensate for variations in the characteristics of the drive transistor and the light-emitting device. During a portion of the combined threshold compensation and data programming phase the drive transistor becomes diode-connected such that the gate and the second terminal of the drive transistor are electrically connected, wherein a threshold voltage of the drive transistor is compensated while the drive transistor is diode-connected. A first capacitor has a first plate that is connected to the gate of the drive transistor and a second plate that is connected to a node N1 at the light-emitting device, and a second capacitor has a first plate that is connected to the gate of drive transistor and the first plate of the first capacitor, and a second plate that is electrically connected to the node N1 during the emission phase.

20 Claims, 5 Drawing Sheets

TFT PIXEL THRESHOLD VOLTAGE COMPENSATION CIRCUIT

TECHNICAL FIELD

The present invention relates to design and operation of electronic circuits for delivering electrical current to an element in a display device, such as for example to an organic light-emitting diode (OLED) in the pixel of an active matrix OLED (AMOLED) display device.

BACKGROUND ART

Organic light-emitting diodes (OLED) generate light by re-combination of electrons and holes, and emit light when a bias is applied between the anode and cathode such that an electrical current passes between them. The brightness of the light is related to the amount of the current. If there is no current, there will be no light emission, so OLED technology is a type of technology capable of absolute blacks and achieving almost "infinite" contrast ratio between pixels when used in display applications.

Several approaches are taught in the prior art for pixel thin film transistor (TFT) circuits to deliver current to an element of a display device, such as for example an organic light-emitting diode (OLED), through a drive transistor. In one example, an input signal, such as a high "SCAN" signal, is employed to a switch transistor in the circuit to permit a data voltage, VDAT, to be stored at a storage capacitor during a programming phase. When the SCAN signal is low and the switch transistor isolates the circuit from the data voltage, the VDAT voltage is retained by the capacitor and this voltage is applied to a gate of a drive transistor. With the drive transistor having a threshold voltage VTH, the amount of current to the OLED is related to the voltage on the gate of the drive transistor by:

$$I_{OLED} = \frac{\beta}{2}(V_{DAT} - V_{OLED} - V_{TH})^2$$

TFT device characteristics, especially the TFT threshold voltage $V_{TH}$, may vary, for example due to manufacturing processes and/or stress and aging of the TFT device during the operation. With the same VDAT voltage, the amount of current delivered by the TFT drive transistor could vary by a large amount due to such threshold voltage variations. Therefore, pixels in a display may not exhibit uniform brightness for a given VDAT value. In addition, OLED device characteristics may vary due to manufacturing processes, and/or stress and aging during the operation of the OLED. For example, the threshold voltage of the OLED for light emission may change. Conventional circuit configurations, therefore, often include elements that operate to compensate for at least some of these component variations to achieve an OLED display with more uniform brightness among sub-pixels.

Conventionally, therefore, OLED pixel circuits have high tolerance ranges to variations in threshold voltage and/or carrier mobility of the drive transistor by employing circuits that compensate for mismatch in the properties of the drive transistors. For example, an approach is described in U.S. Pat. No. 7,414,599 (Chung et al., issued Aug. 19, 2008), which describes a circuit in which the drive TFT is configured to be a diode-connected device during a programming period, and a data voltage is applied to the source of the drive transistor. Such a circuit configuration, however, may not be suitable for a circuit architecture in which the OLED is driven by the source of the drive transistor, such when the drive transistor particular is an indium gallium zinc oxide (IGZO) transistor. IGZO transistors are beneficial because they experience low current leakage when in the off state. In such architecture, the OLED current is affected by the voltage at anode of the OLED, which can lead to variation in the emission.

Another circuit approach is described in U.S. Pat. No. 8,242,983 (Myoung-Hwan Yoo, issued Aug. 14, 2012). In such circuit, a capacitor is connected between the gate and source of the drive transistor with a first plate of the capacitor connected to the anode of the OLED and a second plate connected to the gate of the drive transistor. A threshold voltage is stored across the capacitor between the gate and source of the drive transistor during the threshold compensation phase. During emission, the second plate of the capacitor, to which the gate of the drive transistor is connected, is floating. Any variation at the anode of the OLED will be followed by the gate of the drive transistor. In this way, the threshold voltage of the drive transistor and the voltage variation of the OLED can be compensated. A disadvantage of this configuration is that the data voltage is difficult to store in the capacitor between the gate and the source of the drive transistor, which can reduce accuracy of the data voltage application.

Another circuit approach is described in U.S. Pat. No. 9,666,125 (Chieh-Hsing CHUNG, issued May 30, 2017). In such circuit, one capacitor is used to store the threshold voltage of the drive transistor, and another capacitor is used to store the data voltage. During emission, the two capacitors are series connected between the gate and source of the drive transistor. The threshold voltage and the data voltage are stored between the gate and source of the drive transistor. Any variation at the anode of the OLED will be followed by the gate of the drive transistor. In this way, the data is properly programmed, and the threshold voltage of the drive transistor and the voltage variations of the OLED are compensated. A disadvantage of this configuration, however, is that as the capacitors are series connected, the effective capacitance is smaller than any one capacitor. As there are leakage though the transistor switches, the gate voltage of the drive transistor can drift a large amount over one frame time, and thus the current to the OLED can vary significantly during a frame. To reduce such voltage drift, a large capacitor may be needed, but using a large capacitor may not be a viable solution for high resolution applications in which reduced space is required.

Another circuit approach is described in U.S. Pat. No. 9,196,196 (Bo-Yong Chung, issued Nov. 14, 2015). During the compensation phase, the OLED voltage and threshold voltage of the drive transistor are stored in a storage capacitor. During the data programming phase, the data is distributed between the storage capacitor and a second capacitor. In this way, the OLED voltage, threshold voltage, and data voltage are programmed to the storage capacitor. This configuration, however, has a disadvantage of resulting in a large current flowing through the OLED during the compensation phase, which could lead to light emission during the compensation phase. The light emission during the compensation phase will degrade the blackness and compromise the contrast ratio.

SUMMARY OF INVENTION

The present invention relates to pixel circuits that are capable of compensating the threshold voltage variations of the drive transistor and the voltage variations of the light-emitting device, such as an OLED. The threshold voltage of the drive transistor and the data voltage are programmed to a capacitor that is connected between the gate and the source of the drive transistor. The current variation due to the threshold voltage variations of the drive transistor will be cancelled during emission phase. Any voltage variations at the source of the drive transistor, which may be caused by the variations of the OLED performance, will cause similar voltage changes at the gate of the drive transistor. Hence, the voltage between the gate and source of the drive transistor remains the same. The current controlled by the drive transistor is related to the voltage difference between the gate and the source, and thus the current through the drive transistor and to the OLED is not affected by the variations of the OLED performance.

To achieve such results, a two-capacitor structure is used for a combined threshold compensation and data programming phase. Two capacitors, $C_1$ and $C_2$, are used for threshold compensation with the data voltage being applied at the source of the drive transistor, which also is connected to the anode of the OLED. The threshold voltage of the drive transistor and the data voltage are stored in a first capacitor $C_1$ and the threshold voltage of the drive transistor is stored in a second capacitor $C_2$ during the combined threshold compensation and data programming phase. The data voltage is distributed between the two capacitors. During emission phase, the bottom plates of the capacitors $C_1$ and $C_2$ are electrically connected to the same node. The threshold voltage of the drive transistor and the data voltage are programmed to both the capacitors, which both are electrically connected between the gate and source of the drive transistor during the emission phase. In this manner, the current variation caused by the variations of the threshold voltage of the drive transistor are cancelled during the emission phase. In addition, any voltage variations of the OLED voltage at the source of the drive transistor cause a similar voltage change at the gate of the drive transistor, and thus through the drive transistor and to the OLED is not affected by the variations of the OLED performance due to the OLED voltage. The connection of the plates of the capacitors during the emission phase further stabilizes the voltage applied to the gate of the drive transistor, which further reduces emission variations.

An aspect of the invention, therefore, is a pixel circuit for a display device that employs a two-capacitor configuration, in which during the emission phase, the first and second plates of the capacitors respectively are electrically connected to each other to provide more stability to the gate voltage of the drive transistor. The pixel circuit also is operable in a combined threshold compensation and data programming phase to compensate for variations in the characteristics of the drive transistor and the light-emitting device.

In exemplary embodiments, the pixel circuit includes a drive transistor configured to control an amount of current from a first power supply to a light-emitting device during the emission phase depending upon a voltage input applied to a gate of the drive transistor, and a threshold voltage of the drive transistor is compensated during the combined threshold compensation and data programming phase; wherein the light-emitting device is connected at a first node to a node N1 that is a connection of a first terminal of the drive transistor and the first node of the light emitting device, and at a second node to a second power supply; a second transistor that is connected between the gate and a second terminal of the drive transistor, such that during a portion of the combined threshold compensation and data programming phase the second transistor is in an on state whereby the drive transistor becomes diode-connected such that the gate and the second terminal of the drive transistor are electrically connected through the second transistor, wherein a threshold voltage of the drive transistor is compensated while the drive transistor is diode-connected; a first capacitor having a first plate that is connected to the gate of the drive transistor and a second plate that is connected to the node N1; and a second capacitor having a first plate that is connected to the gate of drive transistor and the first plate of the first capacitor, and a second plate that is electrically connected to the node N1 during the emission phase.

The pixel circuit further may include a third transistor that is connected between the node N1 and a data voltage input line, wherein the third transistor is in an on state during a portion of the combined threshold compensation and data programming phase to apply a data voltage to the node N1; a fourth transistor that is connected between the second plate of the second capacitor and the node N1, wherein during the emission phase the fourth transistor is in an on state and the second plate of the second capacitor is electrically connected to the node N1 through the fourth transistor; a fifth transistor that is connected between the fourth transistor and a reference voltage input line, wherein the fifth transistor is in an on state during a portion of the combined threshold compensation and data programming phase to apply a reference voltage to the second plate of the second capacitor; and/or a sixth transistor that is connected between an input line for the first power supply and the second terminal of the drive transistor, wherein during the emission phase the sixth transistor is in an on state to electrically connect the second terminal of the drive transistor to the first power supply through the sixth transistor.

Another aspect of the invention is a method of operating a pixel circuit according to any of the embodiments, whereby component variations are compensated and a voltage applied to the gate of the drive transistor has enhanced stability. In exemplary embodiments, the method of operating includes the steps of providing a pixel circuit according to any of the embodiments; performing a combined threshold compensation and data programming phase to compensate a threshold voltage of the drive transistor and program a data voltage to the pixel circuit comprising: disconnecting the second terminal of the drive transistor from the first power supply; during a portion of the combined threshold compensation and data programming phase, placing the second transistor in an on state whereby the drive transistor becomes diode-connected such that the gate and the second terminal of the drive transistor are electrically connected through the second transistor, wherein a threshold voltage of the drive transistor is compensated while the drive transistor is diode-connected; applying a reference voltage from a reference voltage input line to the second plate of the second capacitor, and applying a data voltage from a data voltage input line to the node N1; and at the end of the combined threshold compensation and data programming phase, disconnecting the gate and the second terminal of the drive transistor so that the drive transistor is no longer diode-connected, disconnecting the second plate of the second capacitor from the reference voltage input line, and disconnecting the node N1 from the data voltage input line; and performing an emission phase during which light is emitted from the light-emitting device comprising: electrically connecting the second plate of the second capacitor to the node N1, and electrically connecting the first power supply to the second terminal of the drive transistor.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF EMBODIMENTS

Figure 1:
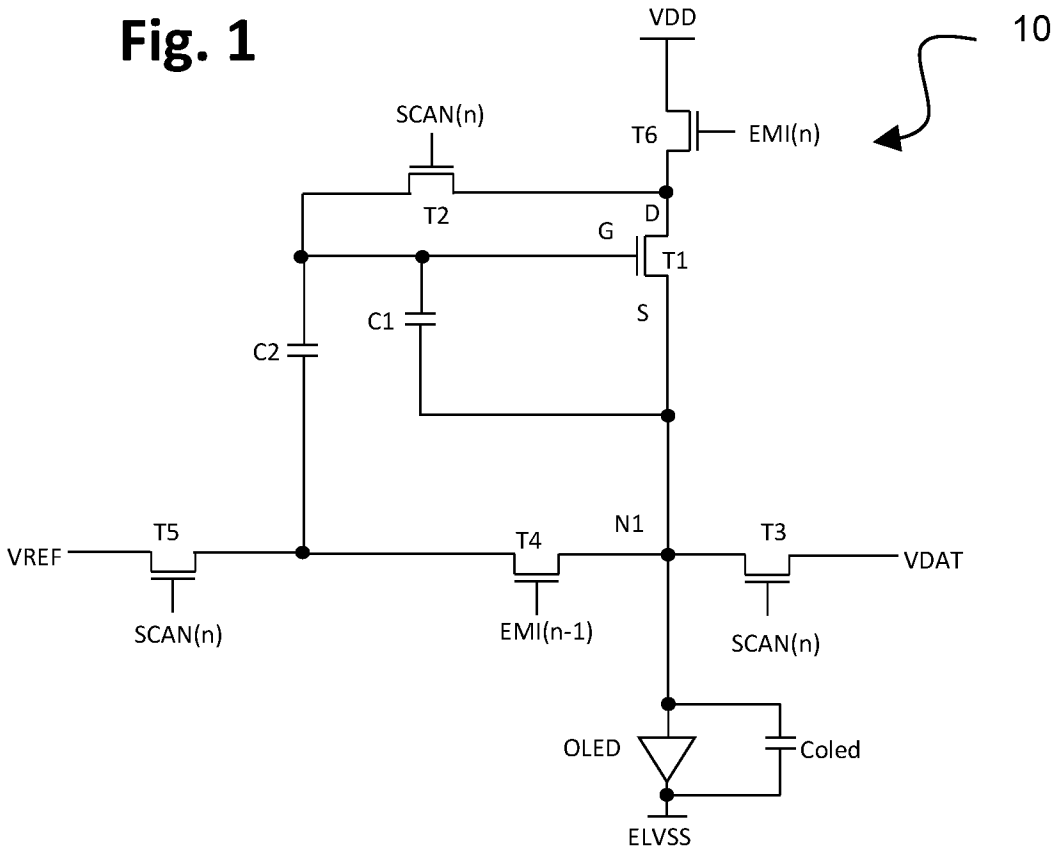
FIG. 1 is a drawing depicting a first circuit configuration in accordance with embodiments of the present invention.

Embodiments of the present invention will now be described with reference to the drawings, wherein like reference numerals are used to refer to like elements throughout. It will be understood that the figures are not necessarily to scale.

Figure 2:
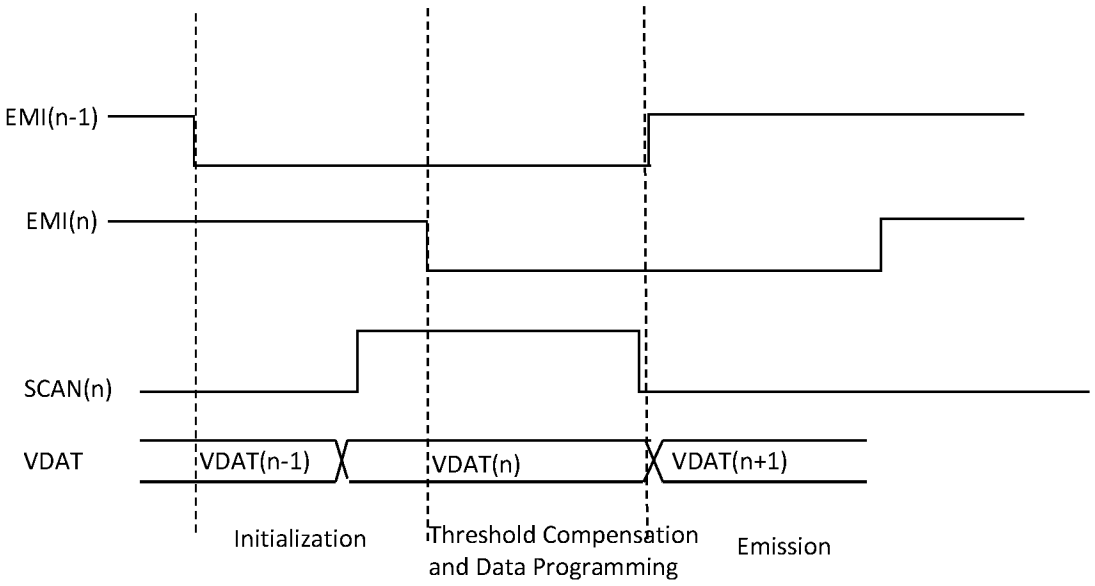
FIG. 2 is a drawing depicting a timing diagram associated with the operation of the circuit of FIG. 1.

FIG. 1 is a drawing depicting a first circuit configuration 10 in accordance with embodiments of the present invention, and FIG. 2 is a timing diagram associated with the operation of the circuit configuration 10 of FIG. 1. In this example, the circuit 10 is configured as a TFT circuit that includes multiple n-type transistors T1-T6 and two capacitors, $C_1$ and $C_2$. The circuit elements drive a light-emitting device, such as for example an OLED. The organic light-emitting device (OLED) has an associated internal capacitance, which is represented in the circuit diagram as $C_{oled}$. In addition, although the embodiments are described principally in connection with an OLED as the light-emitting device, comparable principles may be used with display technologies that employ other types of light-emitting devices, including for example micro LEDs and quantum dot LEDs.

More specifically, FIG. 1 depicts the TFT circuit 10 configured with multiple n-MOS or n-type TFTs. T1 is a drive transistor that is an analogue TFT, and T2-T6 are digital switch TFTs. In FIG. 1 and subsequent figures, the terminals of the drive transistor are labelled: gate (G), source (S), and drain (D). As referenced above, $C_1$ and $C_2$ are capacitors, and $C_{oled}$ is the internal capacitance of the OLED device (i.e., $C_{oled}$ is not a separate component, but is inherent to the OLED). The OLED further is connected to a power supply ELVSS as is conventional.

The OLED and the TFT circuit 10, including the transistors, capacitors and connecting wires, may be fabricated using TFT fabrication processes conventional in the art. It will be appreciated that comparable fabrication processes may be employed to fabricate the TFT circuits according to any of the embodiments.

For example, the TFT circuit 10 (and subsequent embodiments) may be disposed on a substrate such as a glass, plastic, or metal substrate. Each TFT may comprise a gate electrode, a gate insulating layer, a semiconducting layer, a first electrode, and a second electrode. The semiconducting layer is disposed on the substrate. The gate insulating layer is disposed on the semiconducting layer, and the gate electrode may be disposed on the insulating layer. The first electrode and second electrode may be disposed on the insulating layer and connected to the semiconducting layer using vias. The first electrode and second electrode respectively may commonly be referred to as the "source electrode" and "drain electrode" of the TFT. The capacitors may comprise a first electrode, an insulating layer and a second electrode, whereby the insulating layer forms an insulating barrier between the first and second electrodes. Wiring between components in the circuit, and wiring used to introduce signals to the circuit (e.g. SCAN, EMI, VDAT, VREF) may comprise metal lines or a doped semiconductor material. For example, metal lines may be disposed between the substrate and the gate electrode of a TFT, and connected to electrodes using vias. The semiconductor layer may be deposited by chemical vapour deposition, and metal layers may be deposited by a thermal evaporation technique.

The OLED device may be disposed over the TFT circuit. The OLED device may comprise a first electrode (e.g. anode of the OLED), which is connected to transistors T1, T3 and T4 in this example, one or more layers for injecting or transporting charge (e.g. holes) to an emission layer, an emission layer, one or more layers for injecting or transporting electrical charge (e.g. electrons) to the emission layer, and a second electrode (e.g. cathode of the OLED), which is connected to first power supply ELVSS in this example. The injection layers, transport layers and emission layer may be organic materials, the first and second electrodes may be metals, and all of these layers may be deposited by a thermal evaporation technique.

Generally, this embodiment has comparable control signals EMI and SCAN for other rows of pixels in the overall or broader display device, thereby enabling fewer control signal wires in a display configuration as common control lines may be shared over different rows. For this example and in subsequent embodiments, display pixels are addressed by row and column. The current row is row n. The previous row is row n−1, and the second previous row is n−2. The next row is row n+1, and the row after that is row n+2, and so on for the various rows as they relate to the corresponding control signals identified in the figures. Accordingly, for example, SCAN(n) refers to the scan signal at row n and SCAN(n+1) refers to the scan signal at row n+1, and the like. EMI(n) refers to the emission signal at row n and EMI(n−1) refers to the emission signal at row n−1, and the like, and so on for the various control signals. In this manner, for the various embodiments the input signals correspond to the indicated rows.

Referring to the TFT circuit 10 of FIG. 1 in combination with the timing diagram of FIG. 2, the TFT circuit 10 operates to perform in three phases: an initialization phase, a combined threshold compensation and data programming phase, and an emission phase for light emission.

In this first embodiment, during the previous emission phase, the EMI(n) signal level has a high voltage value, so transistor T6 is on. With T6 being on, the light emission is being driven by the input driving voltage VDD connected to the drive transistor T1, whereby the actual current applied to the OLED is determined by the voltage at the gate of the drive transistor. The EMI(n−1) signal level has a high voltage value, so transistor T4 is on. With T4 being on, the bottom plate of the capacitor $C_2$ is connected to the bottom plate of the capacitor $C_1$, and the effective storage capacitance is the combined capacitance of the capacitor $C_1$ and $C_2$. The SCAN signal levels initially have a low voltage value so transistors T2, T3 and T5 are off.

At the beginning of the initialization phase, the EMI(n−1) signal level is changed from the high voltage value to a low voltage value, causing transistor T4 to be turned off. With transistor T4 turning off, the bottom plate of the capacitor $C_2$ is disconnected from a node N1 corresponding to a connection of the anode of the OLED, the source of the drive transistor, and the bottom plate of the capacitor $C_1$. The data voltage, VDAT, is then changed from the value for another pixel (e.g. the previous row of the display VDAT(n−1)) to the data value for the current pixel (e.g. the current row of the display VDAT(n)).

Next during the initialization phase, the SCAN(n) signal level is changed from the low voltage value to a high voltage value, causing transistors T2, T3 and T5 to be turned on. With transistor T2 turning on, the drain and the gate of the drive transistor are connected together and to the power supply VDD. With transistor T3 turning on, a data voltage applied from a data voltage input line, VDAT, is applied to the node N1 corresponding to the connection of the source of the drive transistor, the anode of the OLED, and the bottom plate of the capacitor $C_1$. To avoid light emission, the VDAT voltage should below the threshold voltage of the OLED plus the power supply ELVSS:

$$V_{DAT}<V_{OLED_TH}+V_{ELVSS}$$

With transistor T5 turning on, a reference voltage applied from a reference voltage input line, VREF, is applied to the bottom plate of $C_2$. In this way, the gate of the drive transistor and the top plates of the capacitors $C_1$ and $C_2$ are initialized to the power suppler VDD. In addition, the bottom plate of the capacitor $C_1$ is initialized to VDAT, and the bottom plate of the capacitor $C_2$ is initialized to VREF. The effect of the initialization phase in the various embodiments essentially is to clear memory effects from the previous frame.

Next, during the combined threshold compensation and data programming phase, the EMI(n) signal level is changed from the high voltage value to a low voltage value, causing transistor T6 to be turned off. With transistor T6 turning off, the drain of the drive transistor is disconnected from the power supply, VDD, and becomes floating. As the gate and drain of the drive transistor are electrically connected through transistor T2, the drive transistor is diode-connected, by which the current can only flow in one direction. Diode-connected refers to the drive transistor T1 being operated with its gate and a second terminal (e.g., source or drain, and in this case the drain) being electrically connected, such that current flows in one direction. The source of the drive transistor is electrically connected through T3 to the data voltage input line, VDAT. The voltage level of the drain and gate of the drive transistor will drop from the initial high voltage VDD toward the lower voltage VDAT.

Preferably, to have effective threshold voltage compensation of the drive transistor T1, the voltage at the source of the drive transistor, VDAT, should satisfy the following condition:

$$V_{DD}-V_{DAT}>\Delta V+V_{TH},$$

where $V_{TH}$ is the threshold voltage of the drive transistor T1, and ΔV is a voltage that is large enough to generate a high initial current to charge the storage capacitor within an allocated threshold compensation time. The value of ΔV will depend on the properties of the transistors. For example, ΔV would be at least 3 volts for exemplary low-temperature polycrystalline silicon thin film transistor processes. The data voltage, VDAT, is set to satisfy the voltage requirement:

$$V_{DAT}<V_{DD}-\Delta V-V_{TH}$$

At the end of the threshold compensation, there will be no current flowing from the gate/drain of the drive transistor to the source of the drive transistor. The voltage at the gate/drain of the drive transistor, which is also the top plates of the capacitors $C_1$ and $C_2$ becomes:

$$V_{DAT}+V_{TH}$$

Next during the combined threshold compensation and data programming phase, the SCAN(n) signal level is changed from the high voltage value to the low voltage value, causing transistors T2, T3, and T5 to be turned off. With transistor T2 turning off, the gate and the drain of the drive transistor are disconnected, and thus the drive transistor is no longer diode-connected. With transistor T3 turning off, the bottom plate of the capacitor $C_1$ and the source of the drive transistor are disconnected from the data voltage input line that supplies VDAT. VDAT then may be switched to the data voltage for the next row, VDAT(n+1). With transistor T5 turning off, the bottom plate of the capacitor $C_2$ is disconnected from the reference voltage input line that supplies VREF.

The TFT circuit 10 next is operable in an emission phase during which the OLED is capable of emitting light with a driving voltage input being supplied from VDD through transistor T6. The EMI(n−1) signal level is changed from the low voltage value to the high voltage value, causing transistor T4 be turned on. With transistor T4 turning on, the bottom plate of the capacitor $C_2$ is electrically connected to the node N1 corresponding to the bottom plate of the capacitor $C_1$, the anode of the OLED, and the source of the drive transistor. Then the EMI(n) signal is changed from the low voltage value to the high voltage value, causing transistor T6 to be turned on for supplying the driving voltage VDD.

If the voltage at the anode of OLED is $V_{OLED}$, at the gate of the drive transistor, the top plates of the capacitors $C_1$ and $C_2$ are floating, and the total charge change at the top plates is:

$$(V_{OLED}-V_{DAT})C_1(V_{OLED}-V_{REF})C_2$$

Ignoring the parasitic capacitance at the gate of the drive transistor, the voltage change at the top plates is:

$$(V_{OLED}-V_{DAT})C_1+\frac{(V_{OLED}-V_{REF})C_2}{C_1+C_2}=V_{OLED}-\frac{V_{DAT}C_1+V_{REF}C_2}{C_1+C_2}$$

The voltage at the top plates of capacitor $C_1$ and $C_2$, and thus the gate of the drive transistor becomes:

$$V_{DAT}+V_{TH}+V_{OLED}-\frac{V_{DAT}C_1+V_{REF}C_2}{C_1+C_2}$$

The current that flows through the OLED is:

$$I_{OLED}=\frac{\beta}{2}\left(V_{DAT}+V_{TH}+V_{OLED}-\frac{V_{DAT}C_1+V_{REF}C_2}{C_1+C_2}-V_{OLED}-V_{TH}\right)^2$$

-continued $$= \frac{\beta}{2}\left(\frac{C_2(V_{DAT} - V_{REF})}{C_1 + C_2}\right)^2$$

where $$\beta = \mu_n \cdot C_{ox} \cdot \frac{W}{L},$$

$C_{ox}$ is the capacitance of the drive transistor gate oxide;
W is the width of the drive transistor channel;
L is the length of the drive transistor channel (i.e. distance between source and drain); and
$\mu_n$ is the carrier mobility of the drive transistor.

Accordingly, the current to the OLED does not depend on the threshold voltage of the drive transistor T1 and the voltage variations of the OLED. In this manner, variation in the threshold voltage of the drive transistor and the voltage variations of the OLED have been compensated.

During the emission phase, therefore, the top plates of both capacitors $C_1$ and $C_2$ are connected to each other and to the gate of the drive transistor, and the bottom plates of both capacitors $C_1$ and $C_2$ are electrically connected to each other and to the anode of the OLED and source of the drive transistor (node N1). Accordingly, the voltage across both capacitors is utilized for driving the OLED during the emission phase. A certain capacitance is required to keep the gate voltage of the drive transistor stable during the emission phase to achieve stable light emission. With the two capacitors connected commonly at the top and bottom plates during the emission phase, smaller capacitors are usable as compared to conventional configurations to achieve comparable performance and stability of the light emission. Such use of smaller capacitors is advantageous in high-resolution displays in which spatial limitations are significant.

Figure 3:
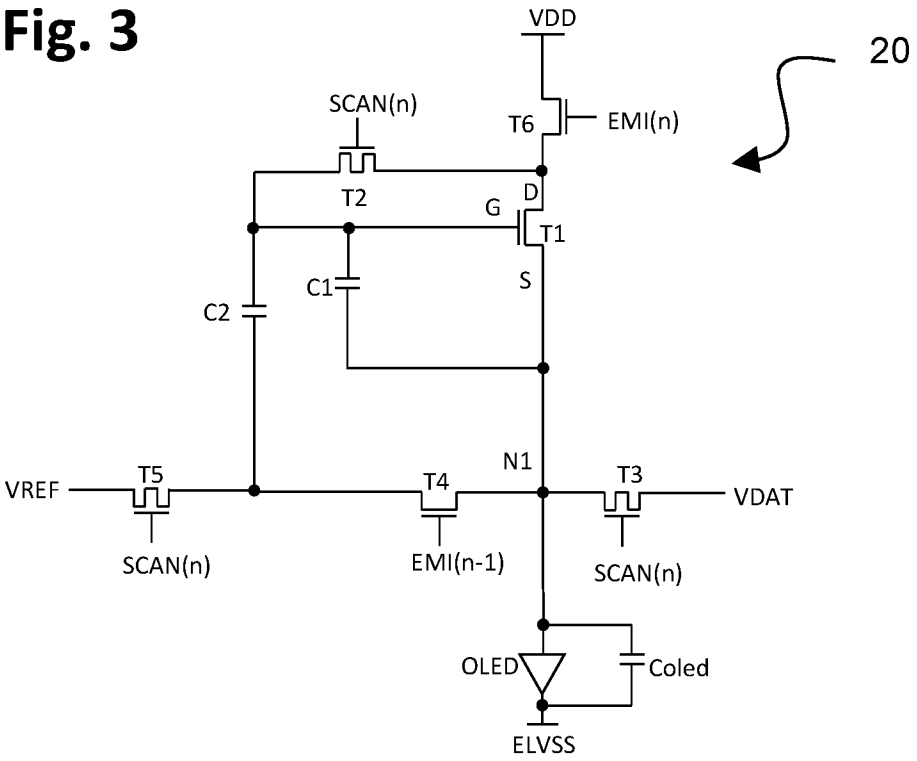
FIG. 3 is a drawing depicting a second circuit configuration in accordance with embodiments of the present invention.

FIG. 3 is a drawing depicting a second circuit configuration 20 in accordance with embodiments of the present invention. The timing and the operation method of the circuit configuration 20 is essentially the same as the first circuit configuration 10. The difference between the first circuit configuration 10 and the second circuit configuration 20 is that transistors T2, T3 and T5 are configured as dual gate transistors in the second circuit configuration. Comparing to the first circuit configuration, the benefit of the dual gate transistors in the second circuit configuration is that the leakage current from the gate of the drive transistor is reduced, and thus the voltage drift from the gate of the drive transistor is reduced. Instead of using dual gate transistors to reduce leakage, transistors T2, T3, and/or T5 alternatively may be ultra-low leakage single gate TFTs, such as an IGZO (Indium gallium zinc oxide) TFT, to achieve a comparable effect of reduced leakage.

One of the factors that affects the amount of the leakage current is off resistance of the switch transistors. Due to process variations resulting from variations in manufacturing and property changes over usage, device mismatch could affect the off resistance. The amount of the leakage current could result in emission variations across the display panel. A reduced leakage current, such as by using dual gate or IGZO transistors as referenced above, results in less variation in the display.

Figure 4:
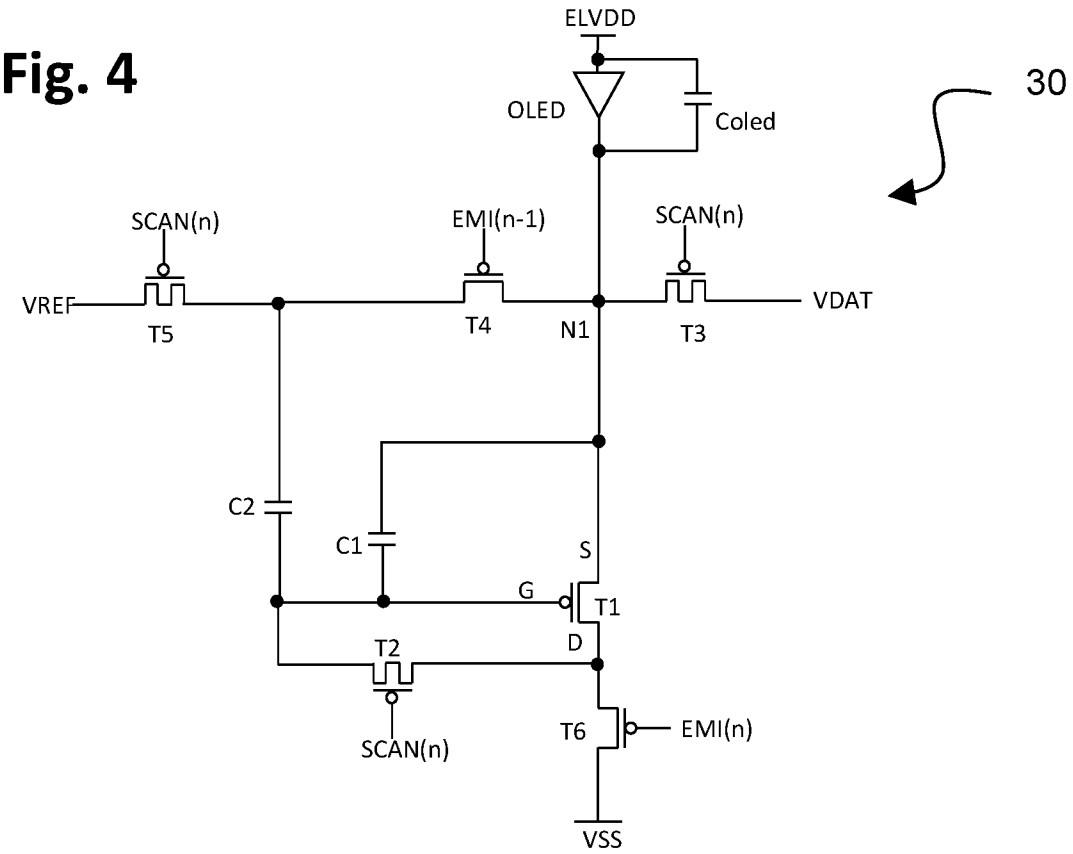
FIG. 4 is a drawing depicting a third circuit configuration in accordance with embodiments of the present invention.
Figure 5:
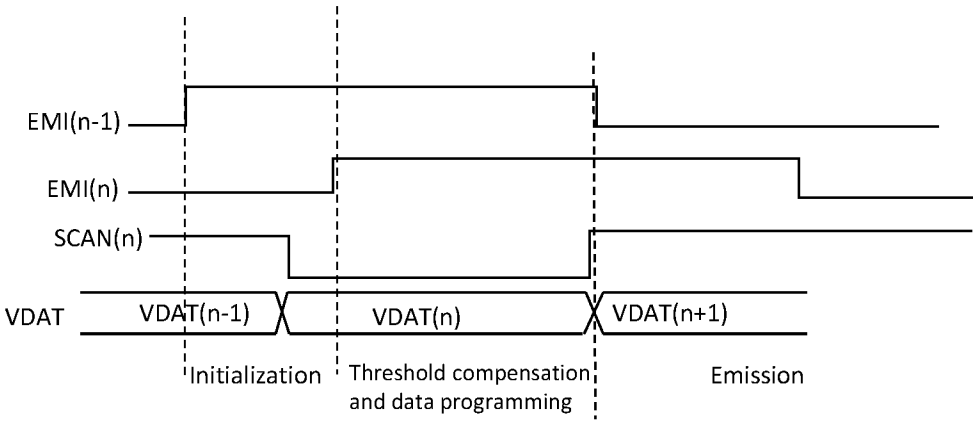
FIG. 5 is a drawing depicting a timing diagram associated with the operation of the circuit of FIG. 4.

FIG. 4 is a drawing depicting a third circuit configuration 30 in accordance with embodiments of the present invention, and FIG. 5 is a timing diagram associated with the operation of the circuit configuration 30 of FIG. 4. The circuit configuration 30 of FIG. 4 operates comparably as the circuit configurations 10 and 20 of FIGS. 1 and 3, except that the circuit configuration 30 employs p-type transistors rather than n-type transistors. As is known in the art, the drive properties of an OLED may be more suitable for one or other of n-type versus p-type transistors, and the principles of the present invention are applicable to either type of configuration. Accordingly, in this example of FIG. 4, the circuit 30 is configured as a TFT circuit that includes multiple p-MOS or p-type TFTs, and two capacitors, $C_1$ and $C_2$. The circuit elements drive a light-emitting device, such as for example an OLED. The organic light-emitting device (OLED) again has an associated internal capacitance, which again is represented in the circuit diagram as $C_{oled}$. In addition, although the embodiments are described principally in connection with an OLED as the light-emitting device, comparable principles may be used with display technologies that employ other types of light-emitting devices, including for example micro LEDs and quantum dot LEDs.

Similarly as in the previous embodiments, T1 is a drive transistor that is an analogue TFT, and T2-T6 are digital switch TFTs. $C_1$ and $C_2$ are capacitors, and $C_{oled}$ is the internal capacitance of the OLED device (i.e., $C_{oled}$ is not a separate component, but is inherent to the OLED). The OLED further is connected to a voltage supply ELVDD as is conventional. In addition, transistors T2, T3, and T5 are depicted as being low leakage, dual gate transistors, comparably as in the embodiment of FIG. 3. As an alternative, single gate transistors comparably as in the embodiment of FIG. 1 may be employed.

Referring to the TFT circuit 30 of FIG. 4 in combination with the timing diagram of FIG. 5, the TFT circuit 10 operates to perform in three phases: an initialization phase, a combined threshold compensation and data programming phase, and an emission phase for light emission. As referenced above, the circuit configuration of FIG. 4 operates comparably as the circuit configurations 10 and 20 of FIGS. 1 and 3, except that the circuit configuration 30 employs p-type transistors rather than n-type transistors. Accordingly, the principal difference of operation is the relative voltage levels of the input control signals (i.e., high voltage versus low voltage values) being set to operate with p-type transistors.

In the embodiment of FIG. 4, during the previous emission phase EMI(n) signal level has a low voltage value, so transistor T6 is on. With T6 being on, the light emission is being driven by the input driving voltage VSS connected to the drive transistor T1, whereby the actual current applied to the OLED is determined by the voltage at the gate of the drive transistor. The EMI(n−1) signal level has a low voltage value, so transistor T4 is on. With T4 being on, the top plate of the capacitor $C_2$ is connected to the top plate of the capacitor $C_1$, and the effective storage capacitance is the combined capacitance of the capacitors $C_1$ and $C_2$. The SCAN(n) signal level initially has a high voltage value so transistors T2, T3 and T5 are off.

Next, at the beginning of the initialization phase, the EMI(n−1) signal level is changed from the low voltage value to a high voltage value, causing transistor T4 to be turned off. With transistor T4 turning off, the top plate of the capacitor $C_2$ is disconnected from a node N1 corresponding to a connection of the cathode of the OLED, the source of the drive transistor, and the top plate of the capacitor $C_1$. Then the data voltage supplied from a data voltage input line, VDAT, is changed from the value for another pixel (e.g.

the previous row of the display VDAT(n−1)) to the data value for the current pixel (e.g. the current row of the display VDAT(n)).

Next during the initialization phase, the SCAN(n) signal level is changed from the high voltage value to a low voltage value, causing transistors T2, T3, and T5 to be turned on. With transistor T2 turning on, the drain and the gate of the drive transistor are connected together and to the power supply VSS. With transistor T3 turning on, the data voltage, VDAT, is applied from the data voltage input line to the node N1 corresponding to the connection of source of the drive transistor, the cathode of the OLED, and the top plate of the capacitor $C_1$. To avoid light emission, the VDAT voltage should higher than the power supply ELVDD minus the threshold voltage of the OLED:

$$V_{DAT}<V_{ELVDD}-V_{OLED_TH}$$

With transistor T5 turning on, a reference voltage, VREF, is applied from a reference voltage input line to the top plate of $C_2$. In this way, the gate of the drive transistor and the bottom plates of the capacitors $C_1$ and $C_2$ are initialized to the power suppler VSS. In addition, the top plate of the capacitor $C_1$ is initialized to VDAT, and the top plate of the capacitor $C_2$ is initialized to VREF. As referenced above, the effect of the initialization phase in the various embodiments essentially is to clear memory effects from the previous frame.

Next, during the combined threshold compensation and data programming phase, the EMI(n) signal level is changed from the low voltage value to the high low voltage value, causing transistor T6 to be turned off. With transistor T6 turning off, the gate/drain of the drive transistor and the bottom plates of the capacitors $C_1$ and $C_2$ are disconnected from the power supply, VSS, and becomes floating. As the gate and drain of the drive transistor are electrically connected through transistor T2, the drive transistor is diode-connected similarly as in the previous embodiment. The source of the drive transistor is electrically connected through T3 to the data voltage input line that supplies the data voltage, VDAT. The voltage level of the gate and drain of the drive transistor will raise from the initial low voltage VSS toward a higher voltage VDAT.

Preferably, to have effective threshold voltage compensation of the drive transistor T1, the voltage at the source of the drive transistor, VDAT, should satisfy the following condition:

$$V_{DAT}-V_{SS}>\Delta V+|V_{TH}|,$$

where $V_{TH}$ is the threshold voltage of the drive transistor T1, and ΔV is a voltage that is large enough to generate a high initial current to charge the storage capacitor within an allocated threshold compensation time. The value of ΔV will depend on the properties of the transistors. For example, ΔV would be at least 3 volts for exemplary low-temperature polycrystalline silicon thin film transistor processes. The data voltage, VDAT, is set to satisfy the voltage requirement:

$$V_{DAT}>V_{SS}+\Delta V+|V_{TH}|$$

At the end of the threshold compensation, there will be no current flowing from the gate/drain of the drive transistor to the source of the drive transistor. The voltage at the gate/drain of the drive transistor and the bottom plates of the capacitors $C_1$ and $C_2$ becomes:

$$V_{DAT}-|V_{TH}|$$

Next during the combined threshold compensation and data programming phase, then SCAN(n) signal level is changed from the low voltage value to the high voltage value, causing transistors T2, T3, and T5 to be turned off. With transistor T2 turning off, the gate and the drain of the drive transistor are disconnected, and thus the drive transistor is no longer diode-connected. With transistor T3 turning off, the top plate of the capacitor $C_1$ and the source of the drive transistor are disconnected from the data voltage input line that supplies VDAT. VDAT then may be switched to the data voltage for the next row, VDAT(n+1). With transistor T5 turning off, the top plate of the capacitor $C_2$ is disconnected from the reference voltage input line that supplies VREF.

The TFT circuit 30 next is operable in an emission phase during which the OLED is capable of emitting light with a driving voltage input being supplied from VSS through T6. The EMI(n−1) signal level is changed from the high voltage value to the low voltage value, causing transistor T4 to be turned on. With transistor T4 turning on, the top plate of the capacitor $C_2$ is electrically connected to the note N1 corresponding to the connection top plate of the capacitor $C_1$, the source of the drive transistor, and the cathode of the OLED. Then the EMI(n) signal is changed from the high voltage value to the low voltage value, causing transistor T6 to be turned on for supplying the driving voltage VSS.

If the voltage at cathode of OLED is $V_{OLED}$, as the gate of the drive transistor, the top plates of the capacitor $C_1$ and $C_2$ are floating, and the total charge change at the top plates is:

$$(V_{OLED}-V_{DAT})C_1(V_{OLED}-V_{REF})C_2$$

Ignoring the parasitic capacitance at the gate of the drive transistor, the voltage change at the bottom plates is:

$$\frac{(V_{OLED}-V_{DAT})C_1+(V_{OLED}-V_{REF})C_2}{C_1+C_2}=V_{OLED}-\frac{V_{DAT}C_1+V_{REF}C_2}{C_1+C_2}$$

The voltage at the bottom plates of capacitors $C_1$ and $C_2$, and thus the gate of the drive transistor becomes:

$$V_{DAT}-|V_{TH}|+V_{OLED}-\frac{V_{DAT}C_1+V_{REF}C_2}{C_1+C_2}$$

The current that flows through the OLED is:

$$I_{OLED}=\frac{\beta}{2}\left(V_{DAT}-|V_{TH}|+V_{OLED}-\frac{V_{DAT}C_1+V_{REF}C_2}{C_1+C_2}-V_{OLED}-V_{TH}\right)^2=\frac{\beta}{2}\left(\frac{C_2(V_{DAT}-V_{REF})}{C_1+C_2}\right)^2$$

where $$\beta=\mu_n\cdot C_{ox}\cdot\frac{W}{L},$$

$C_{ox}$ is the capacitance of the drive transistor gate oxide;
W is the width of the drive transistor channel;
L is the length of the drive transistor channel (i.e. distance between source and drain); and
$\mu_n$ is the carrier mobility of the drive transistor.

Accordingly, the current to the OLED does not depend on the threshold voltage of the drive transistor T1 and the voltage variations of the OLED. In this manner, variation in the threshold voltage of the drive transistor and the voltage variations of the OLED have been compensated.

Similarly as in the previous embodiment, therefore, during the emission phase the bottom plates of both capacitors $C_1$ and $C_2$ are connected to each other and to the gate of the drive transistor, and the top plates of both capacitors $C_1$ and $C_2$ are electrically connected to each other and to the cathode of the OLED and source of the drive transistor (node N1). Accordingly, the voltage across both capacitors is utilized for driving the OLED during the emission phase. As referenced above, a certain capacitance is required to keep the gate voltage of the drive transistor stable during the emission phase to achieve stable light emission. With the two capacitors connected commonly at the top and bottom plates during the emission phase, smaller capacitors are usable as compared to conventional configurations to achieve comparable performance and stability of the light emission. Such use of smaller capacitors is advantageous in high-resolution displays in which spatial limitations are significant.

An aspect of the invention, therefore, is a pixel circuit for a display device that employs a two-capacitor configuration, in which during the emission phase, the first and second plates of the capacitors respectively are electrically connected to each other to provide more stability to the gate voltage of the drive transistor. The pixel circuit also is operable in a combined threshold compensation and data programming phase to compensate for variations in the characteristics of the drive transistor and the light-emitting device.

In exemplary embodiments, the pixel circuit includes a drive transistor configured to control an amount of current from a first power supply to a light-emitting device during the emission phase depending upon a voltage input applied to a gate of the drive transistor, and a threshold voltage of the drive transistor is compensated during the combined threshold compensation and data programming phase; wherein the light-emitting device is connected at a first node to a node N1 that is a connection of a first terminal of the drive transistor and the first node of the light emitting device, and at a second node to a second power supply; a second transistor that is connected between the gate and a second terminal of the drive transistor, such that during a portion of the combined threshold compensation and data programming phase the second transistor is in an on state whereby the drive transistor becomes diode-connected such that the gate and the second terminal of the drive transistor are electrically connected through the second transistor, wherein a threshold voltage of the drive transistor is compensated while the drive transistor is diode-connected; a first capacitor having a first plate that is connected to the gate of the drive transistor and a second plate that is connected to the node N1; and a second capacitor having a first plate that is connected to the gate of drive transistor and the first plate of the first capacitor, and a second plate that is electrically connected to the node N1 during the emission phase. The pixel circuit may include one or more of the following features, either individually or in combination.

In exemplary embodiment of the pixel circuit, the pixel circuit further includes a third transistor that is connected between the node N1 and a data voltage input line, wherein the third transistor is in an on state during a portion of the combined threshold compensation and data programming phase to apply a data voltage to the node N1.

In exemplary embodiment of the pixel circuit, the pixel circuit further includes a fourth transistor that is connected between the second plate of the second capacitor and the node N1, wherein during the emission phase the fourth transistor is in an on state and the second plate of the second capacitor is electrically connected to the node N1 through the fourth transistor.

In exemplary embodiment of the pixel circuit, a gate of the fourth transistor is connected to an emission control signal line for a previous row.

In exemplary embodiment of the pixel circuit, the pixel circuit further includes a fifth transistor that is connected between the fourth transistor and a reference voltage input line, wherein the fifth transistor is in an on state during a portion of the combined threshold compensation and data programming phase to apply a reference voltage to the second plate of the second capacitor.

In exemplary embodiment of the pixel circuit, at least one of the second, third, and fifth transistors is a dual gate transistor.

In exemplary embodiment of the pixel circuit, gates of the second, third, and fifth transistors are connected to a common SCAN control signal line.

In exemplary embodiment of the pixel circuit, the pixel circuit further includes a sixth transistor that is connected between an input line for the first power supply and the second terminal of the drive transistor, wherein during the emission phase the sixth transistor is in an on state to electrically connect the second terminal of the drive transistor to the first power supply through the sixth transistor.

In exemplary embodiment of the pixel circuit, a gate of the sixth transistor is connected to an emission control signal line for a current row.

In exemplary embodiment of the pixel circuit, the light-emitting device is one of an organic light-emitting diode, a micro light-emitting diode (LED), or a quantum dot LED.

In exemplary embodiment of the pixel circuit, the transistors are p-type transistors.

In exemplary embodiment of the pixel circuit, the transistors are n-type transistors.

In exemplary embodiment of the pixel circuit, the transistors are n-type transistors, and at least one of the second, third, and fifth transistors is an indium gallium zinc oxide transistor.

Another aspect of the invention is a method of operating a pixel circuit according to any of the embodiments, whereby component variations are compensated and a voltage applied to the gate of the drive transistor has enhanced stability. In exemplary embodiments, the method of operating includes the steps of providing a pixel circuit according to any of the embodiments; performing a combined threshold compensation and data programming phase to compensate a threshold voltage of the drive transistor and program a data voltage to the pixel circuit comprising: disconnecting the second terminal of the drive transistor from the first power supply; during a portion of the combined threshold compensation and data programming phase, placing the second transistor in an on state whereby the drive transistor becomes diode-connected such that the gate and the second terminal of the drive transistor are electrically connected through the second transistor, wherein a threshold voltage of the drive transistor is compensated while the drive transistor is diode-connected; applying a reference voltage from a reference voltage input line to the second plate of the second capacitor, and applying a data voltage from a data voltage input line to the node N1; and at the end of the combined threshold compensation and data programming phase, disconnecting the gate and the second terminal of the drive transistor so that the drive transistor is no longer diode-connected, disconnecting the second plate of the second capacitor from the reference voltage input line, and disconnecting the node N1 from the data voltage input line; and performing an emission phase during which light is emitted from the light-emitting device comprising: electrically connecting the second plate of the second capacitor to the node N1, and electrically connecting the first power supply to the second terminal of the drive transistor. The method of operating may include one or more of the following features, either individually or in combination.

In an exemplary embodiment of the method of operating, the combined threshold compensation and data programming phase further comprises placing the third transistor in an on state to apply the data voltage.

In an exemplary embodiment of the method of operating, the emission phase further comprises placing the fourth transistor is in an on state to electrically connect the second plate of the second capacitor to the node N1 through the fourth transistor.

In an exemplary embodiment of the method of operating, the combined threshold compensation and data programming phase further comprises placing the fifth transistor in an on state to apply the reference voltage through the fifth transistor.

In an exemplary embodiment of the method of operating, the emission phase further comprises placing the sixth transistor in an on state to electrically connect the second terminal of the drive transistor to the first power supply through the sixth transistor.

In an exemplary embodiment of the method of operating, for control of on and off states of the transistors: a gate of the fourth transistor is connected to an emission control signal line for a previous row; gates of the second, third, and fifth transistors are connected to a common SCAN control signal line; and a gate of the sixth transistor is connected to an emission control signal line for a current row.

In an exemplary embodiment of the method of operating, the method further includes performing an initialization phase comprising: disconnecting the second plate of the second capacitor from the first terminal of the drive transistor; electrically connecting the second plate of the second capacitor to the reference voltage input line; diode-connecting the drive transistor by connecting the gate and the second terminal of the drive transistor through the second transistor; and connecting the first terminal of the drive transistor to the data voltage input line.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

INDUSTRIAL APPLICABILITY

Embodiments of the present invention are applicable to many display devices to permit display devices of high resolution with effective threshold voltage compensation and true black performance. Examples of such devices include televisions, mobile phones, personal digital assistants (PDAs), tablet and laptop computers, desktop monitors, digital cameras, and like devices for which a high resolution display is desirable.

REFERENCE SIGNS LIST

10—first circuit configuration
20—second circuit configuration
30—third circuit configuration
T1-T6—multiple transistors
OLED—organic light emitting diode (or generally light-emitting device)
$C_1$, $C_2$—capacitors
$C_{oled}$—internal capacitance of OLED
VDAT—data voltage supplied by data voltage input line
VDD—power supply
VSS—power supply
ELVSS—power supply
ELVDD—power supply
VREF—reference voltage supplied by reference voltage input line
SCAN/EMI—control signals

What is claimed is:

1. A pixel circuit for a display device operable in a combined threshold compensation and data programming phase and an emission phase, the pixel circuit comprising:

a drive transistor configured to control an amount of current from a first power supply to a light-emitting device during the emission phase depending upon a voltage input applied to a gate of the drive transistor, and a threshold voltage of the drive transistor is compensated during the combined threshold compensation and data programming phase;

wherein the light-emitting device is connected at a first node to a node N1 that is a connection of a first terminal of the drive transistor and the first node of the light emitting device, and at a second node to a second power supply;

a second transistor that is connected between the gate and a second terminal of the drive transistor, such that during a portion of the combined threshold compensation and data programming phase the second transistor is in an on state whereby the drive transistor becomes diode-connected such that the gate and the second terminal of the drive transistor are electrically connected through the second transistor, wherein a threshold voltage of the drive transistor is compensated while the drive transistor is diode-connected;

a first capacitor having a first plate that is connected to the gate of the drive transistor and a second plate that is connected to the node N1; and a second capacitor having a first plate that is connected to the gate of drive transistor and the first plate of the first capacitor, and a second plate that is electrically connected to the node N1 during the emission phase.

2. The pixel circuit of claim 1, further comprising a third transistor that is connected between the node N1 and a data voltage input line, wherein the third transistor is in an on state during a portion of the combined threshold compensation and data programming phase to apply a data voltage to the node N1.

3. The pixel circuit of claim 2, further comprising a fourth transistor that is connected between the second plate of the second capacitor and the node N1, wherein during the emission phase the fourth transistor is in an on state and the second plate of the second capacitor is electrically connected to the node N1 through the fourth transistor.

4. The pixel circuit of claim 3, wherein a gate of the fourth transistor is connected to an emission control signal line for a previous row.

5. The pixel circuit of claim 3, further comprising a fifth transistor that is connected between the fourth transistor and a reference voltage input line, wherein the fifth transistor is in an on state during a portion of the combined threshold compensation and data programming phase to apply a reference voltage to the second plate of the second capacitor.

6. The pixel circuit of claim 5, wherein at least one of the second, third, and fifth transistors is a dual gate transistor.

7. The pixel circuit of claim 5, wherein gates of the second, third, and fifth transistors are connected to a common SCAN control signal line.

8. The pixel circuit of claim 5, further comprising a sixth transistor that is connected between an input line for the first power supply and the second terminal of the drive transistor, wherein during the emission phase the sixth transistor is in an on state to electrically connect the second terminal of the drive transistor to the first power supply through the sixth transistor.

9. The pixel circuit of claim 8, wherein a gate of the sixth transistor is connected to an emission control signal line for a current row.

10. The pixel circuit of claim 5, wherein the transistors are n-type transistors, and at least one of the second, third, and fifth transistors is an indium gallium zinc oxide transistor.

11. The pixel circuit of claim 1, wherein the light-emitting device is one of an organic light-emitting diode, a micro light-emitting diode (LED), or a quantum dot LED.

12. The pixel circuit of claim 1, wherein the transistors are p-type transistors.

13. The pixel circuit of any of claim 1, wherein the transistors are n-type transistors.

14. A method of operating a pixel circuit for a display device comprising the steps of:

providing a pixel circuit comprising:

a drive transistor configured to control an amount of current from a first power supply to a light-emitting device during an emission phase depending upon a voltage input applied to a gate of the drive transistor;

wherein the light-emitting device is connected at a first node to a node N1 that is a connection of a first terminal of the drive transistor and the first node of the light emitting device, and at a second node to a second power supply;

a second transistor that is connected between the gate and a second terminal of the drive transistor;

a first capacitor having a first plate that is connected to the gate of the drive transistor and a second plate that is connected to the node N1; and a second capacitor having a first plate that is connected to the gate of drive transistor and the first plate of the first capacitor, and a second plate that is electrically connected to the node N1 during the emission phase;

performing a combined threshold compensation and data programming phase to compensate a threshold voltage of the drive transistor and program a data voltage to the pixel circuit comprising:

disconnecting the second terminal of the drive transistor from the first power supply;

during the combined threshold compensation and data programming phase, placing the second transistor in an on state whereby the drive transistor becomes diode-connected such that the gate and the second terminal of the drive transistor are electrically connected through the second transistor, wherein a threshold voltage of the drive transistor is compensated while the drive transistor is diode-connected;

applying a reference voltage from a reference voltage input line to the second plate of the second capacitor, and applying a data voltage from a data voltage input line to the node N1; and at the end of the combined threshold compensation and data programming phase, disconnecting the gate and the second terminal of the drive transistor so that the drive transistor is no longer diode-connected, disconnecting the second plate of the second capacitor from the reference voltage input line, and disconnecting the node N1 from the data voltage input line; and performing an emission phase during which light is emitted from the light-emitting device comprising: electrically connecting the second plate of the second capacitor to the node N1, and electrically connecting the first power supply to the second terminal of the drive transistor.

15. The method of operating of claim 14, wherein the pixel circuit further comprises a third transistor that is connected between the node N1 and the data voltage input line, and the combined threshold compensation and data programming phase further comprises placing the third transistor in an on state to apply the data voltage.

16. The method of operating of claim 15, wherein the pixel circuit further comprises a fourth transistor that is connected between the second plate of the second capacitor and the node N1, and the emission phase further comprises placing the fourth transistor is in an on state to electrically connect the second plate of the second capacitor to the node N1 through the fourth transistor.

17. The method of operating of claim 16, wherein the pixel circuit further comprises a fifth transistor that is connected between the fourth transistor and the reference voltage input line, and the combined threshold compensation and data programming phase further comprises placing the fifth transistor in an on state to apply the reference voltage through the fifth transistor.

18. The method of operating of claim 17, wherein the pixel circuit further comprises a sixth transistor that is connected between an input line for the first power supply and the second terminal of the drive transistor, wherein the emission phase further comprises placing the sixth transistor in an on state to electrically connect the second terminal of the drive transistor to the first power supply through the sixth transistor.

19. The method of operating claim 18, wherein for control of on and off states of the transistors:

a gate of the fourth transistor is connected to an emission control signal line for a previous row;

gates of the second, third, and fifth transistors are connected to a common SCAN control signal line; and a gate of the sixth transistor is connected to an emission control signal line for a current row.

20. The method of operating of claim 14, further comprising performing an initialization phase comprising:

disconnecting the second plate of the second capacitor from the first terminal of the drive transistor;

electrically connecting the second plate of the second capacitor to the reference voltage input line;

diode-connecting the drive transistor by connecting the gate and the second terminal of the drive transistor through the second transistor; and connecting the first terminal of the drive transistor to the data voltage input line.

* * * * *